United States Patent [19]

Hattori et al.

[11] 4,079,711

[45] Mar. 21, 1978

[54] AIR-FUEL RATIO CONTROLLING DEVICE

[75] Inventors: Tadashi Hattori, Okazaki; Hiroaki Yamaguchi, Nukata; Takamichi Nakase, Gamagori, all of Japan

[73] Assignee: Nippon Soken, Inc., Nishio, Japan

[21] Appl. No.: 742,990

[22] Filed: Nov. 18, 1976

[30] Foreign Application Priority Data

Nov. 21, 1975 Japan ..... 50-140465

[51] Int. Cl.[2] ..... F01N 3/15; F02B 75/10; F02M 37/00

[52] U.S. Cl. ..... 123/119 EC; 123/32 EE; 123/119 D; 123/124 R

[58] Field of Search ..... 123/119 EC, 119 E, 119 VC, 123/119 D, 124 R, 124 A, 124 B, 32 EE, 32 EL; 60/276, 285

[56] References Cited

U.S. PATENT DOCUMENTS

| | | | |
|---|---|---|---|
| 3,745,768 | 7/1973 | Zecanall et al. | 123/32 EE |
| 3,759,232 | 8/1973 | Wahl | 123/119 D |
| 3,815,561 | 6/1977 | Seitz | 123/32 EE |
| 3,827,237 | 8/1974 | Linder et al. | 123/32 EE |
| 3,960,118 | 6/1976 | Konomi et al. | 123/32 EE |
| 3,973,529 | 8/1976 | Wessell et al. | 123/32 EE |
| 4,019,470 | 4/1977 | Asano | 123/32 EE |
| 4,020,813 | 5/1977 | Hattori et al. | 123/124 B |
| 4,029,061 | 6/1977 | Asano | 123/32 EE |
| 4,031,866 | 6/1977 | Asano | 123/32 EE |

*Primary Examiner*—Wendell E. Burns
*Attorney, Agent, or Firm*—Cushman, Darby & Cushman

[57] ABSTRACT

In an air-fuel ratio controlling device which comprises an exhaust gas sensor for detecting the air-fuel ratio of mixture and an additional air passage including a bypass valve and disposed to supply additional air to the downstream side of the throttle valve of an engine, the controlling device further comprises a throttle sensor operatively connected to the throttle valve for producing an output signal corresponding to the opening of the throttle valve, and a control circuit responsive to the signal from the throttle sensor whereby a predetermined time period after the occurrence of a change in the opening of the throttle valve is discriminated as the acceleration or deceleration period of the engine and the bypass valve is driven at one or the other of two speed depending on whether the engine is in the accleration/deceleration operating condition or other operating conditions.

4 Claims, 5 Drawing Figures

AIR-FUEL RATIO CONTROLLING DEVICE

The present invention relates to an air-fuel ratio controlling device for an internal combustion engine wherein the air-fuel ratio of the mixture is feedback controlled to be substantially constant irrespective of the operating conditions of the engine and thereby accomplish the desired exhaust emission control of the engine.

Conventional air-fuel ratio controlling devices of the above type are so constructed that the air-fuel ratio of the mixture is detected from the oxygen content of the exhaust gases or the like by a gas sensor mounted in the exhaust system of the engine and a valve which controls the amount of additional air is operated in response to the signal from the gas sensor to thereby feedback control the air-fuel ratio of the mixture at the correct value.

However, these conventional systems are not fully satisfactory in that excepting the effect of variations in the air-fuel ratio, the effects of other factors of the engine are not practically taken into consideration. Namely, the conventional devices are disadvantageous in that the delay time between the occurrence of a change in the air-fuel ratio in the intake system of an engine and the detection of the change by the gas sensor mounted in the exhaust system varies considerably under different operating conditions of the engine and consequently in the feedback control of the air-fuel ratio the range of variations of the air-fuel ratio is greatly affected by the delay time during acceleration and deceleration periods of the engine thus making it impossible to ensure satisfactory control of the air-fuel ratio.

Another disadvantage is that if the control is effected to suit the acceleration and deceleration operating conditions of the engine, in the low speed, light load range of the engine the range of variations in the air-fuel ratio is increased thus deteriorating the purfication percentage of a catalyst for purifying the exhaust gases discharged from the engine and moreover a surging phenomenon is caused during running of the vehicle with the resulting deterioration of its drivability.

With a view to overcoming the foregoing difficulty, it is an object of the present invention to provide an air-fuel ratio controlling device for an internal combustion engine of the type in which the operation of a bypass valve is feedback controlled in response to the signal from a gas sensor, wherein there are further provided a throttle sensor operatively connected to the throttle valve of the engine to produce a signal corresponding to the opening of the throttle valve and a control circuit responsive to the signal from the throttle sensor whereby a predetermined period after the occurrence of a change in the opening of the throttle valve is discriminated as the acceleration or deceleration period of the engine and the operating speed of the bypass valve is changed from one speed to another depending on whether the engine is in the acceleration/deceleration operation or other operations, thereby reducing the effect of the system delay time to always control the air-fuel ratio satisfactorily and ensure full display of the ability of a catalyst and eliminating the possibility of a surging phenomenon to ensure an improved drivability.

These and other objects, features and advantages of the present invention will be apparent from the following detailed description taken in conjunction with the accompanying drawings, in which.

The present invention will now be described in greater detail with reference to the illustrated embodiment.

Figure 1:
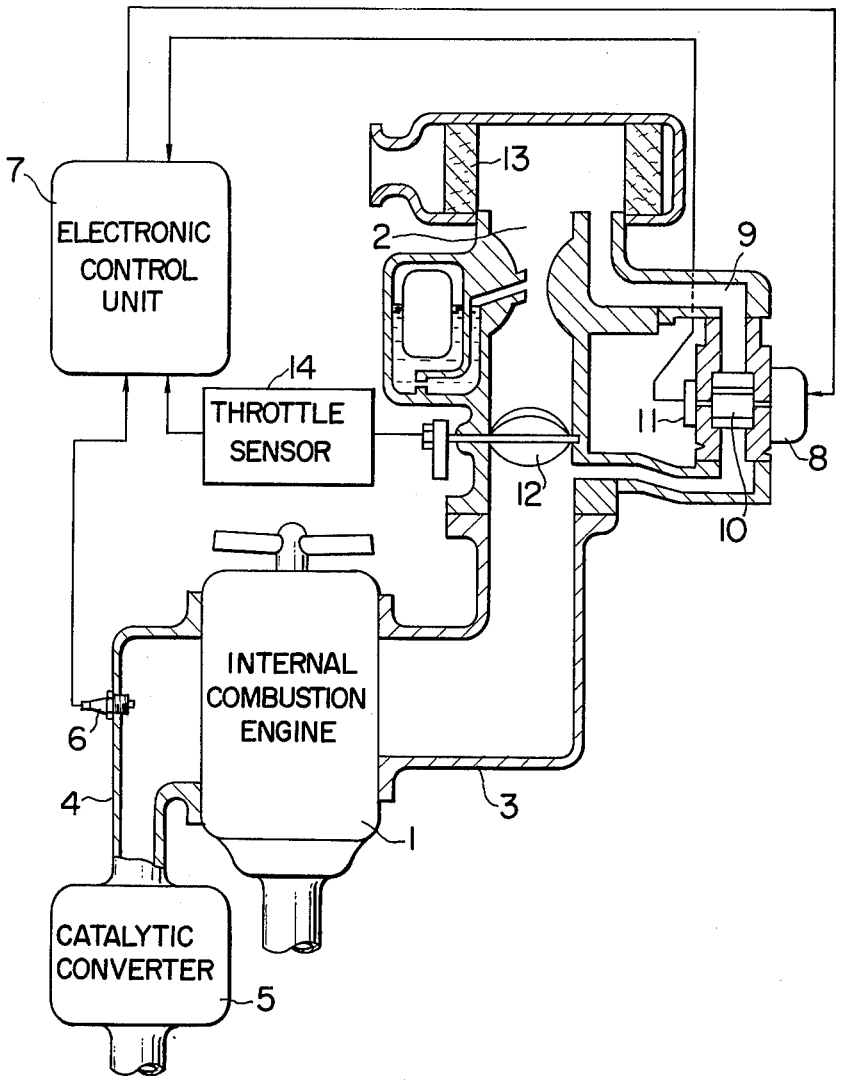
FIG. 1 is a schematic diagram showing the overall construction of an embodiment of the invention.

Referring to FIG. 1 illustrating the overall system of the invention, an internal combustion engine 1 is the conventional spark-ignition, four-cycle engine and air-fuel mixture is supplied to the engine 1 by a carburetor 2 through an intake manifold 3. The carburetor 2 having a main passage, is of the conventional type and it has been set to produce an air-fuel mixture which is slightly rich as compared with the desired air-fuel ratio demanded by the engine 1.

Figure 4:
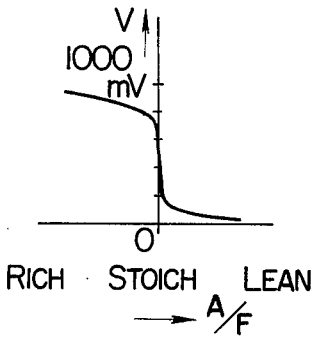
FIG. 4 is an output characteristic diagram of the gas sensor shown in FIG. 2.

Disposed in the exhaust system of the engine 1 are an exhaust manifold 4 and a three-way catalytic converter 5 and also mounted in the exhaust manifold 4 is a gas sensor 6 which detects by a metal oxide such as zirconium dioxide or titanium dioxide the content of oxygen, a constituent, of the exhaust gases. Where the gas sensor 6 employs zirconium dioxide, for example, as shown in FIG. 4, the gas sensor 6 comes into operation at around the stoichiometric air-fuel ratio so that when the detected air-fuel ratio is rich (small) as compared with the stoichiometric one, it produces an electromotive force between 80 and 100 mV, whereas when the detected air-fuel ratio is lean (large) as compared with the stoichiometric one, the resulting electromotive force is on the order of 10 to 0 mV. An electronic control unit 7 is responsive to the signals from the gas sensor 6, etc., to drive a four-phase pulse motor 8 in a selected direction. The pulse motor 8 operates a bypass valve 10 mounted in an additional air passage or a bypass passage 9 to open and close and the drive shaft of the pulse motor 8 is connected to the bypass valve 10. The bypass valve 10 is a known butterfly valve and there is provided a full closed position switch 11 so that when the bypass valve 10 is in its fully closed position, this is detected and a fully closed position signal is produced and applied to the control unit 7.

An arbitrarily actuatable throttle valve 12 is mounted in the downstream portion of the carburetor 2 and the upstream portion of the carburetor 2 includes an air cleaner 13. The additional air passage 9 is disposed to communicate the air cleaner 13 with the downstream side of the throttle valve 12.

A throttle sensor 14 senses acceleration and deceleration of the engine 1 which are delay time factors and in the present embodiment the throttle sensor 14 comprises a potentiometer operatively connected to the throttle valve 12 and so set that its resistance value increases in proportion to increase in the opening of the throttle valve 12.

The throttle sensor 14 and the fully closed position switch 11 are connected to the electronic control unit 7 which in turn receives as its input signals the signals from the throttle sensor 14 and the fully closed position switch 11 in addition to the signal from the gas sensor 6, so that the direction of rotation and the rotational speed of the four-phase pulse motor 8 constituting a part of the controlling means are controlled in accordance with these input signals and the amount of additional air is varied to thereby control the air-fuel ratio of the mixture correctly.

Figure 2:
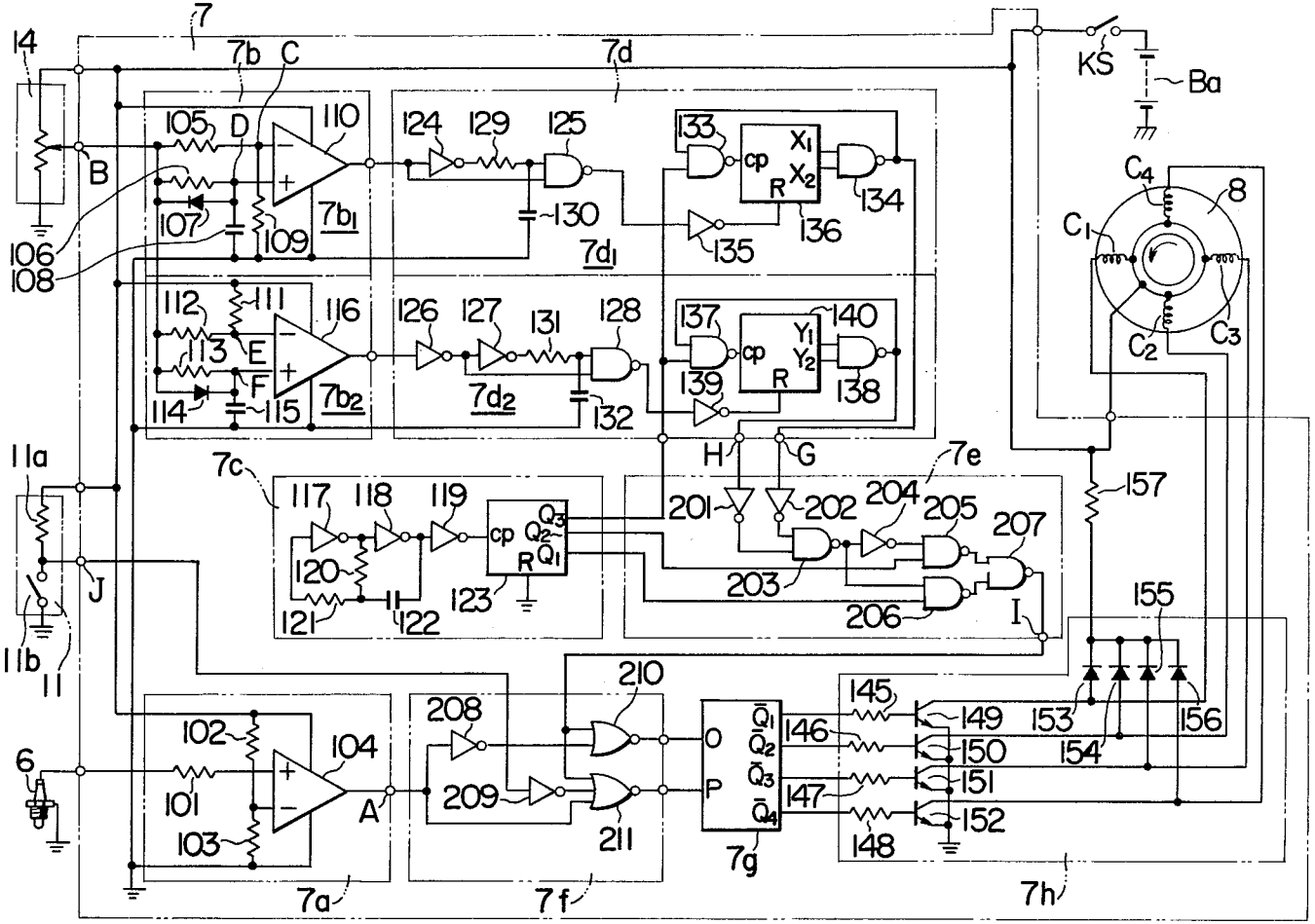
FIG. 2 is a circuit diagram of the electronic control unit shown in FIG. 1.

The control unit 7 will now be described in greater detail with reference to FIG. 2. A comparison circuit 7*a* comprises an input resistor 101, voltage dividing resistors 102 and 103, and a differential operational amplifier (OP AMP) 104, and the OP AMP 104 has its noninverting input terminal connected to the gas sensor 6 through the input resistor 101 and its inverting terminal to the voltage dividing point of the dividing resistors 102 and 103. Thus, the comparison circuit 7*a* compares its input voltage with a preset voltage preset by the voltage dividing resistors 102 and 103 (i.e., the voltage practically equal to the electromotive force produced by the gas sensor 6 at the stoichiometric air-fuel ratio), so that a "1" level signal is produced at its output terminal A when the input voltage is higher than the preset voltage or richer than the stoichiometric one, whereas a "0" level signal is produced at the output terminal A when it is lower than the preset voltage or leaner than the stoichiometric one.

An acceleration/deceleration detection circuit 7*b* which constitutes an input section for receiving the signal from the throttle sensor 14, comprises an acceleration detection circuit $7b_1$ including resistors 105, 106 and 109, a diode 107, a capacitor 108 and an OP AMP 110, and a deceleration detection circuit $7b_2$ including resistors 111, 112 and 113, a diode 114, a capacitor 115 and an OP AMP 116.

The acceleration detection circuit $7b_1$ is designed so tht it produces a "0" level signal only for a predetermined time after the beginning of acceleration of the engine 1 in response to the signal from the throttle sensor 14. In other words, the acceleration detection circuit $7b_1$ receives as its input signal a voltage $V_B$ at a variable terminal B of the potentiometer constituting the throttle sensor 14 and a voltage $V_C$ at a voltage dividing point C of the resistors 105 and 109 and a voltage $V_D$ at a terminal D of the capacitor 108 are so set that a relation $V_D > V_C$ is established between the voltages $V_C$ and $V_D$ during the normal operation of the engine 1 (namely, when the opening of the throttle valve 12 is maintained constant) and the output of the OP AMP 110 goes to the "1" level. Then, as the engine 1 is accelerated so that the throttle valve 12 is opened and the voltage $V_B$ at the terminal B of the potentiometer rises, in response to this input signal the voltage $V_C$ increases without any time delay and the voltage $V_D$ increases with a delay due to the integration action of the resistor 106 and the capacitor 108. Consequently, during the acceleration period the relation between the voltages $V_C$ and $V_D$ becomes $V_D < V_C$ for a predetermined time in response to the opening movement of the throttle valve 12 and thus the output of the OP AMP 110 becomes $V_D - V_C$, namely, it goes from the "1" to "0" level. When the voltage $V_D$ increases at the expiration of the predetermined time, the relation is returned to $V_D > V_C$ and the output of the OP AMP 110 goes back to the "1" level.

During the deceleration period of the engine 1, although the voltage $V_B$ at the terminal B of the potentiometer decreases, the capacitor 108 is rapidly discharged by the diode 107 so that the output of the OP AMP 110 does not change its state and an excellent acceleration detection sensitivity is ensured against rapid repetitions of alternate acceleration and deceleration.

The deceleration detection circuits $7b_2$ operates practically in the same manner as the acceleration detection circuit $7b_1$, namely, it produces a "1" level signal only for a predetermined time after the beginning of deceleration of the engine 1 in response to the signal from the throttle valve 12. In other words, the deceleration detection circuit $7b_2$ receives as its input signal the output voltage $V_B$ of the potentiometer and a voltage $V_E$ at a voltage dividing point E of the voltage dividing resistors 111 and 112 and a voltage $V_F$ at a terminal F of the capacitor 115 are so set that a relation $V_E > V_F$ holds therebetween during the normal operation of the engine 1 (namely, when the opening of the throttle valve 12 is maintained constant) and the output of the OP AMP 116 goes to the "0" level. Then, during deceleration of the engine 1 the output voltage $V_B$ of the potentiometer decreases in response to the closing of the throttle valve 12, so that in response to this input signal the voltage $V_E$ increases without any time delay and the voltage $V_F$ decreases with a delay due to the integration action of the resistor 113 and the capacitor 115. Consequently, during the deceleration period the relation between the voltages $V_E$ and $V_F$ becomes $V_E < V_F$ only for a predetermined time and the output of the OP AMP 116 becomes $V_F - V_E$, namely, the output goes from the "0" to "1" level. When the voltage $V_F$ decreases at the expiration of the predetermined time, the relation $V_E > V_F$ is restored and the output of the OP AMP 116 goes back to the "0" level.

Further, while the output voltage $V_B$ of the potentiometer increases during acceleration periods of the engine 1, the capacitor 115 is rapidly discharged by the diode 114 with the result that the output of the OP AMP 116 does not change its state and an excellent deceleration detection sensitivity is ensured against rapid repetitions of alternate acceleration and deceleration.

A pulse generating circuit 7*c* comprises an oscillator circuit including inverters 117, 118 and 119, resistors 120 and 121 and a capacitor 122 for producing clock pulses and a frequency divider 123 employing a binary counter for dividing the frequency of the clock pulses. The outputs of the pulse generating circuit 7*c* are delivered from frequency dividing outputs $Q_1$, $Q_2$ and $Q_3$ of the frequency divider 123 and the output pulse frequencies are preset so that $Q_1 > Q_2 > Q_3$.

A timing circuit 7*d* comprises an acceleration timing circuit $7d_1$ and a deceleration timing circuit $7d_2$ each of which is responsive to the signal from the acceleration/deceleration detection circuit 7*b* to produce a "1" level signal for a predetermined period. More specifically, the acceleration timing circuit $7d_1$ comprises a first one-shot circuit including an inverter 125, a NAND gate 125, a resistor 129 and a capacitor 130 and a first timer circuit including NAND gates 133 and 134, an inverter 135 and a frequency divider 136 for producing a $\frac{1}{2}$ frequency divided ouput $X_1$ and a $\frac{1}{4}$ frequency divided output $X_2$, and the deceleration timing circuit $7d_2$ similarly comprises a second one-shot circuit including inverters 126 and 127, a NAND gate 128, a resistor 131 and a capacitor 132 and a second timer circuit including NAND gates 137 and 138, an inverter 139 and a frequency divider 140 for producing a $\frac{1}{2}$ frequency divided output $Y_1$ and a $\frac{1}{8}$ frequency divided output $Y_2$.

During acceleration and deceleration periods of the engine 1, the first and second one-shot circuits respond respectively to the signals from the acceleration and deceleration detection circuits $7b_1$ and $7b_2$ and apply a reset signal to the frequency dividers 136 and 140, respectively, thus causing the first and second timer circuits respectively to come into operation. In this case, the timing settings of the outputs from the first and second timer circuits are respectively determined by the frequency divided outputs of the frequency dividers 136 and 140 which are applied to the NAND gates 134 and 138. For example, if $f_1$ represents the frequency of the clock pulse produced from the output $Q_3$ of the pulse generating circuit *7c*, during the acceleration period the first timer circuit comes into operation in response to a reset signal, so that a $\frac{1}{2}$ frequency divided output $X_1$ and a $\frac{1}{4}$ frequency divided output $X_2$ are applied to the NAND gate 134 and thus the output of the NAND gate 134 is held at the "1" level for the duration of $3/f_1$ seconds (including the maximum error of $-\frac{1}{2}f_1$ seconds) after the reception of the reset signal from the first one-shot circuit. Similarly, during the deceleration period the second timer circuit comes into operation in response to a reset signal, so that a $\frac{1}{2}$ frequency divided output $Y_1$ and a $\frac{1}{8}$ frequency divided output $Y_2$ are applied to the NAND gate 138 and the output of the NAND gate 138 is held at the "1" level for $5/f_1$ seconds after the receipt of the reset signal from the second one-shot circuit.

Thus, as the output of the timing circuit *7d*, a "1" level signal is produced at its output terminal H or G for a predetermined time after the time of operation of the throttle valve 12 during the acceleration or deceleration operation and this time interval is discriminated as the acceleration or deceleration period.

A frequency selection circuit *7e* comprises inverters 201, 202 and 204 and NAND gates 203, 205, 206 and 207 and it is responsive to the signal from the timing circuit *7d* to discriminate whether the engine 1 is under the acceleration/deceleration operating condition or the normal operating condition, thus selecting the output pulses of the corresponding frequency from the pulse generating circuit *7c* and applying the pulses to a command circuit *7f*. In other words, during the acceleration or deceleration period, the output of the NAND gate 203 goes to the "1" level thus causing the frequency divided output $Q_1$ of the pulse generating circuit *7c* to appear at an output terminal I of the frequency selection circuit *7e*, whereas during the normal operation the output of the NAND gate 203 goes to the "0" level thus causing the frequency divided output $Q_2$ to appear at the output terminal I. The fully closed position switch 11 comprises a resistor 11*a* and switch 11*b* whereby when the bypass valve 10 is in the fully closed position, the switch 11*b* is closed and a "0" level signal is produced at an output terminal J.

Figure 3A:
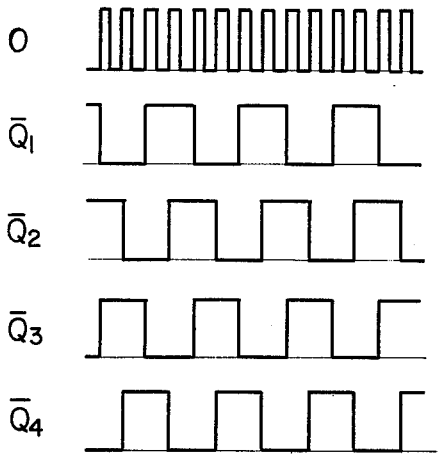
FIGS. 3A and 3B are waveform diagrams useful for explaining the operation of the reversible shift register shown in FIG. 2.
Figure 3B:
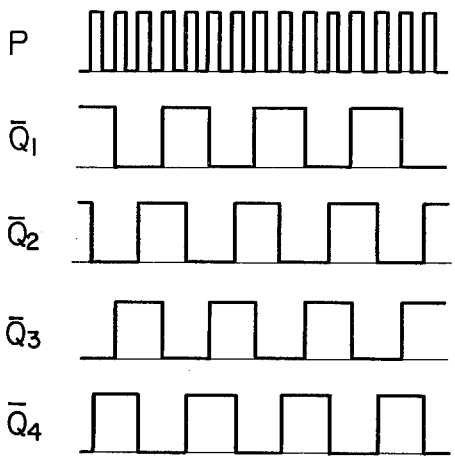

The command circuit *7f* comprises inverters 208 and 209 and NOR gates 210 and 211 and it receives as its input signals the signals from the comparison circuit *7a*, the frequency selection circuit *7e* and the fully closed position switch 11. More specifically, the output of the comparison circuit *7a* is applied to the NOR gate 210 through the inverter 208 and to the NOR gate 211 directly and thus a "0" level signal is applied to one of these NOR gates depending on whether the air-fuel mixture is rich or lean (i.e., whether the air-fuel ratio is smaller or greater than a preset air-fuel ratio). The output of the frequency selection circuit *7e* is directly applied to the NOR gates 210 and 211, respectively, and the output of the fully closed position switch 11 is also applied to the NOR gate 211 through the inverter 209. The outputs of the NOR gates 210 and 211 are supplied respectively to input terminals O and P of a reversible shift register *7g*, so that one of the NOR gates 210 and 211 is opened depending on whether the air-fuel mixture is rich or lean and depending on whether the engine 1 is in the acceleration/deceleration or normal operating condition the pulses of the corresponding frequency are applied from the pulse generating circuit *7c* to the reversible shift register *7g*. When the pulse signals are applied to the input terminal O of the reversible shift register *7f*, its output terminals $\overline{Q}_1$, $\overline{Q}_2$, $\overline{Q}_3$ and $\overline{Q}_4$ are sequentially shifted as shown in FIG. 3A. On the contrary, when the pulse signals are applied to the input terminal P, the output terminals $\overline{Q}_4$, $\overline{Q}_3$, $\overline{Q}_2$ and $\overline{Q}_1$ are sequentially shifted as shown in FIG. 3B. These output terminals $\overline{Q}_1$, $\overline{Q}_2$, $\overline{Q}_3$ and $\overline{Q}_4$ are connected to a switching circuit *7h* comprising resistors 145,146,147 and 148, transistors 149, 150, 151 and 152 and back electromotive force absorbing diodes 153, 154, 155 and 156 and the switching circuit *7h* is in turn connected to field coils $C_1$, $C_2$, $C_3$ and $C_4$ of the four-phase pulse motor 8. When the pulse signals are applied to the input terminal O of the reversible shift resister *7g*, the transistors 149, 150, 151 and 152 are sequentially turned on and the field coils $C_1$, $C_2$, $C_3$ and $C_4$ are similarly energized two phases at a time, thus rotating the rotor of the pulse motor 8 in the direction of the arrow in FIG. 2 and thereby rotating the bypass valve 10 in a direction which opens it. On the contrary, when the pulse signals are applied to the terminal P, the rotor of the pulse motor 8 is rotated in a direction opposite to the direction of the arrow and the bypass valve 10 is rotated in a direction which closes it.

The control unit 7 and the pulse motor 8 are supplied with power from a battery Ba by way of an ignition key switch KS of the engine 1.

With the construction described above, in the normal operation of the engine 1, the throttle valve 12 is maintained in a fixed position and the output signal of the acceleration/deceleration detection circuit *7b* remains unchanged. Consequently, the timing circuit *7d* produces no reset signal and the output of the NAND gate 203 in the frequency selection circuit *7e* remains at the "0" level. As a result, the NAND gate 205 is opened and the frequency divided output $Q_2$ or the low frequency output pulses of the pulse generating circuit *7c* are delivered as the output of the frequency selection circuit *7e* and applied to the command circuit *7f*. The command circuit *7f* applies the low frequency pulses to the input terminal O or P of the reversible shift register *7g* in accordance with the signal from the comparison circuit *7a* and the pulse motor 8 is rotated in the corresponding direction, thus operating the bypass valve 10 and thereby controlling the flow rate of additional air to maintain the air-fuel ratio of mixture at a predetermined value, for example, the stoichiometric one. In this case, since the pulse motor 8 is operated by the low frequency pulses, by setting this pulse frequency to one which is suitable for use in the low speed, light load range of the engine, it is possible to operate the bypass valve 10 at a proper operating speed with the result that the amount of additional air supplied to the intake manifold 3 is properly controlled and thereby reducing the danger of the amount of additional air supply becoming excessively large or small due to the effect of the system delay time and maintaining the control range of the air-fuel ratio of mixture small.

During the acceleration or deceleration period of the engine 1, the opening of the throttle valve 12 is changed so that the output of the acceleration/deceleration detection circuit 7*b* changes its state for a predetermined time and a reset signal is produced from one of the first and second one-shot circuits of the timing circuit 7*d*. The reset signal is applied to either the frequency divider 136 or 140 which in turn produces the corresponding frequency divided outputs and a "1" level signal is produced for a predetermined time at the output terminal H or G of the timing circuit 7*d*. In this way, a predetermined time interval following a change in the opening of the throttle valve 12 and the resulting production of a reset signal is discriminated as the acceleration or deceleration condition, namely, a time period sufficient for dealing with the acceleration or deceleration of the engine 1 is discriminated as the acceleration or deceleration period. Thus, during the acceleration period, the output of the NAND gate 203 of the frequency selection circuit 7*e* goes to the "1" level and the NAND gate 206 is opened. Consequently, the frequency divided output $Q_1$ or the high frequency output pulses of the pulses generating circuit 7*c* are delivered as the output of the frequency selection circuit 7*e* and applied to the command circuit 7*f*. Then, in the similar manner as during the normal operation, the pulse motor 8 is operated in the driving direction determined by the signal from the comparison circuit 7*a* and the air-fuel ratio of mixture is compensated. Thus, the pulse motor 8 is operated by the high frequency pulses at a high operating speed well suited for the acceleration or deceleration operation and moreover the acceleration and deceleration conditions are not discriminated as the transient acceleration and deceleration which occur only when the opening of the throttle valve 12 is changed, but are discriminated as the acceleration and deceleration periods each corresponding to a predetermined time determined by the timing circuit 7*d*. Consequently, the pulse motor 8 is operated sufficiently for the duration of a time required during the acceleration and deceleration periods of the engine 1 and the amount of additional air supplied into the intake manifold 3 is rapidly controlled for the required time corresponding to the acceleration and deceleration, thus reducing the control range of the air-fuel ratio of mixture. In this way, the driving direction as well as the driving speed of the bypass valve 10 are always properly selected and determined and the optimum feedback control is accomplished throughout the range of operating conditions of the engine 1.

In the acceleration and deceleration conditions or the transient conditions of the engine, an improved follow up or response characteristic is ensured for the transient response of the feedback control for rapidly compensating the air-fuel ratio and moreover the operating speed of the bypass valve can be properly set for the steady-state conditions to thereby reduce the effect of the system delay time under the low speed, light load conditions. Thus, there is a remarkable effect of reducing the control range of the air-fuel ratio, improving the purification percentage of the exhaust gas purifying catalyst especially, three-way catalytic converters and eliminating the problem of surging. Further, since the feedback control is effected by discriminating as the acceleration or deceleration period a time interval following a change in the opening of the throttle valve, the adjustment of detection sensitivity in response to differences in the amount of depression of the accelerator pedal which operates the throttle valve can be easily effected and moreover there is no possibility of deterioration in the detection sensitivity even against repetitions of acceleration and deceleration, thus ensuring detection of accelerations and decelerations with improved accuracy to accomplish the feedback control.

The present invention is not intended to be limited to the above-described embodiment. For example, while the timing circuit for discriminating as the acceleration or deceleration period a predetermined time after the production of a signal from the acceleration/deceleration detection circuit is comprised of a digital circuit, it may be comprised of an analog circuit. Further, while, in the above-described embodiment, the amount of additional air is feedback controlled in the intake system, the similar effects may be obtained by applying the present invention to a system in which the amount of additional air supplied into the exhaust system by an air pump or the like, i.e., the secondary air is feedback controlled to control the so-called exhaust gas air-fuel ratio. Still further, while the pulse motor is operated at the same speed during the acceleration periods as well as the deceleration periods, a different operating speed may be used independently for each of the acceleration and deceleration periods.

What is claimed is:

1. An air-fuel ratio controlling device for an internal combustion engine which has an intake system and an exhaust system comprising:

a carburetor connected to the intake system of said internal combustion engine for supplying a rich air-fuel mixture, said carburetor including an intake passage and a throttle valve disposed in said intake passage for controlling the amount of intake air-flow flowing therethrough, said carburetor also including a bypass passage for supplying additional air and a bypass valve disposed in said bypass passage for compensating the air-fuel ratio of the air-fuel mixture by controlling the amount of additional air-flow flowing therethrough;

a drive motor coupled to said bypass valve for driving the same;

gas sensing means mounted in the exhaust system of said engine for sensing the oxygen content of the exhaust gases and deriving an electrical sensing signal;

throttle sensing means coupled to said throttle valve for producing a signal corresponding to the opening degree of said throttle valve; and electronic control means electrically connected to said drive motor, said gas sensing means and said throttle sensing means for driving said drive motor in response to the signals from said gas sensing means and said throttle sensing means, said electronic control means including a comparison circuit for receiving the signal from said gas sensing means and comparing the same with a predetermined value to determine the direction of operation of said drive motor, an acceleration/deceleration detection circuit for receiving the signal from said throttle sensing means and sensing a rapid change in the opening degree of said throttle valve to change the state of the output signal thereof for a predetermined period after said change in the throttle opening, a timing circuit electrically connected to said acceleration/deceleration detection circuit for discriminating a predetermined time after the change in said output signal as an accelerator/deceleration period of said engine and thereby producing a timing signal, and a circuit for receiving said timing signal whereby said drive motor is operated at a first speed during said acceleration/deceleration period, whereas said drive motor is operated at a second speed lower than said first speed during engine operations other than said acceleration/deceleration period, thereby maintaining the air-fuel ratio substantially at a stoichiometric air-fuel ratio.

2. An air-fuel ratio controlling device for an internal combustion engine which has an intake system and an exhaust system comprising:

mixture supply means provided in the intake system of said internal combustion engine for supplying a mixture of intake air and fuel to said engine, said mixture supply means including an intake passage and a throttle valve disposed in said intake passage for controlling the amount of said intake air;

gas sensing means mounted in the exhaust system of said engine for sensing the composition of exhaust gases flowing therethrough and deriving an electrical signal;

means defining a passage for supplying additional air to the upstream side of said gas sensing means in said engine;

a bypass valve disposed in said passage means for controlling the amount of the additional air therethrough;

drive means coupled to said bypass valve for driving said bypass valve to open and close;

throttle sensing means coupled to said throttle valve for producing a signal corresponding to the opening degree of said throttle valve; and a control unit operatively connected to said gas sensing means, said throttle sensing means and said drive means, said control unit being responsive to the signal from said gas sensing means for driving said drive means in selected one of the bypass valve opening and closing directions thereof, said control unit being responsive to the signal from said throttle sensing means for sensing a rapid change in the opening degree of said throttle valve and discriminating a predetermined time after said rapid change in the opening degree of said throttle valve as an acceleration/deceleration period of said engine, whereby said drive means is operated rapidly during said acceleration/deceleration period, whereas said drive means is operated at a lower speed during other operations of said engine.

3. A device according to claim 1, wherein said throttle sensing means includes a potentiometer having a variable terminal, and wherein said acceleration/deceleration detection circuit comprises an acceleration detection circuit including a first differential amplifier having two input terminals, a first L-circuit including first and second resistors and interconnecting one of the input terminals of said first differential amplifier, said variable terminal and a ground terminal, a second L-circuit including a third resistor and a first capacitor and interconnecting the other input terminal of said first differential amplifier, said variable terminal and said ground terminal and a first diode connecting the junction point of said first capacitor and said third resistor to said variable terminal for allowing rapid discharge of said first capacitor, and a deceleration detection circuit including a second differential amplifier having two input terminals, a third L-circuit including fourth and fifth resistors and interconnecting one of the input terminals of said second differential amplifier, said variable terminal and a power supply terminal, a fourth L-circuit including a sixth resistor and a second capacitor and interconnecting the other input terminal of said second differential amplifier, said variable terminal and said power supply terminal, and a second diode connecting the junction point of said second capacitor and said sixth resistor to said variable terminal for allowing rapid charge of said second capacitor.

4. A device according to claim 2, wherein said throttle sensing means includis a potentiometer having a variable terminal, and wherein said control unit comprises an acceleration/deceleration detection circuit including an acceleration detection circuit including a first differential amplifier having two input terminals, a first L-circuit including first and second resistors and interconnecting one of the input terminals of said first differential amplifier, said variable terminal and a ground terminal, a second L-circuit including a third resistor and a first capacitor and interconnecting the other input terminal of said first differential amplifier, said variable terminal and said ground terminal and a first diode connecting the junction point of said first capacitor and third resistor to said variable terminal for allowing rapid discharge of said first capacitor, and a deceleration detection circuit including a second differential amplifier having two input terminals, a third L-circuit including fourth and fifth resistors and interconnecting one of the input terminals of said second differential amplifier, said variable terminal and a power supply terminal, a fourth L-circuit including a sixth resistor and a second capacitor and interconnecting the other input terminal of said second differential amplifier, said variable terminal and said power supply terminal and a second diode connecting the junction point of said second capacitor and said sixth resistor to said variable terminal for allowing rapid charge of said second capacitor.

* * * * *